United States Patent [19]

Castonguay et al.

[11] Patent Number: 4,806,893

[45] Date of Patent: Feb. 21, 1989

[54] MOLDED CASE CIRCUIT BREAKER ACTUATOR-ACCESSORY UNIT

[75] Inventors: Roger N. Castonguay, Terryville; Robert A. Morris, Burlington; Richard A. Dziura, Plainville; Graham A. Scott, Avon; Gregory T. DiVincenzo, Plainville, all of Conn.

[73] Assignee: General Electric Company, New York, N.Y.

[21] Appl. No.: 163,589

[22] Filed: Mar. 3, 1988

[51] Int. Cl.[4] ..... H01H 73/06

[52] U.S. Cl. ..... 335/20; 335/14; 335/175

[58] Field of Search ..... 335/20, 14, 6, 18, 174, 335/175

[56] References Cited

U.S. PATENT DOCUMENTS 4,297,663 10/1981 Seymour et al. ..... 335/20
4,589,052 5/1986 Dougherty ..... 361/94
4,622,444 11/1986 Kandatsu et al. ..... 200/303
4,641,117 2/1987 Willard ..... 335/7
4,679,019 7/1987 Todaro et al. ..... 335/172
4,700,161 10/1987 Todaro et al. ..... 335/172

FOREIGN PATENT DOCUMENTS 2033177 9/1978 United Kingdom .

*Primary Examiner*—H. Broome
*Attorney, Agent, or Firm*—Richard A. Menelly; Walter C. Bernkopf; Fred Jacob

[57] ABSTRACT

An integrated protection unit is a circuit breaker which includes basic overcurrent protection facility along with selective electrical accessories. A molded plastic accessory access cover secured to the integrated protection unit cover protects the accessory components contained within the integrated protection unit cover from the environment. A combined overcurrent trip actuator and multiple accessory unit can be field-installed within the integrated protection unit. The combined actuator-accessory unit includes electronic control circuitry for the accessories along with mechanical trip and reset interface components.

29 Claims, 6 Drawing Sheets

MOLDED CASE CIRCUIT BREAKER ACTUATOR-ACCESSORY UNIT

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. An example of one such factory installed circuit breaker accessory is found in U.S. Pat. No. 4,297,663 entitled "Circuit Breaker Accessories Packaged in a Standardized Molded Case", which Patent is incorporated herein for reference purposes.

A more recent example of a circuit breaker including additional accessories is found in U.S. Pat. No. 4,622,444 entitled "Circuit Breaker Housing and Attachment Box" which allows the accessories to be field-installed within the circuit breaker without interfering with the integrity of the circuit breaker internal components. This is accomplished by mounting the accessories within a recess formed in the circuit breaker enclosure cover.

An electronic trip actuator which is mounted within the circuit breaker enclosure is described within U.S. Pat. No. 4,679,019 entitled "Trip Actuator for Molded Case Circuit Breakers". The circuit breaker actuator responds to trip signals generated by an electronic trip unit completely contained within a semi-conductor chip such as that described within U.S. Pat. No. 4,589,052. The development of a combined trip actuator for both overcurrent protection as well as accessory function is found within U.S. Pat. No 4,700,161 entitled "Combined Trip Unit and Accessory Module for Electronic Trip Circuit Breakers". The aforementioned U.S. Patents which represent the advanced state of the art of circuit protection devices are incorporated herein for reference purposes.

A shunt trip accessory unit allows the circuit breaker operating mechanism to be articulated to separate the circuit breaker contacts, usually to perform a tripping function for electrical system control and protection. One such shunt trip accessory unit is described within U.S. patent application Ser. No. 133,867 filed Dec. 16, 1987 entitled "Molded Case Circuit Breaker Shunt Trip Unit". An auxiliary switch accessory unit allows an operator to determine the "ON" or "OFF" conditions of a molded case circuit breaker contacts at a remote location by means of an audible alarm or visible display. One such auxiliary switch unit is described within U.S. patent application Ser. No. 133,868 filed Dec. 16, 1987 entitled "Molded Case Circuit Breaker Auxiliary Switch Unit". Both of the aforementioned U.S. patent applications are incorporated herein for purposes of reference.

One example of an undervoltage release circuit is found within United Kingdom Patent Application No. 2,033,177A entitled "Circuit Breaker with Undervoltage Release". The circuit described within this Application applies a large initial current pulse to the undervoltage release coil to drive the plunger against the bias of a powerful compression spring and uses a ballast resistor to limit the holding current to the undervoltage release coil to a lower value. It is believed that the heat generated within this circuit would not allow the circuit to be contained within the confines of the circuit breaker enclosure.

A more recent example of a combined overcurrent trip actuator and multiple accessory unit is described within U.S. patent application Ser. No. 133,869 filed Dec. 16, 1987 entitled "Molded Case Circuit Breaker Multiple Accessory Unit" which combined overcurrent trip actuator and multiple accessory unit requires a separate mounting recess within the circuit breaker cover to house the printed wire board that carries the accessory control circuit. This Application is also incorporated herein for reference purposes. The present invention improves thereover by providing an integrated overcurrent trip actuator and multiple accessory unit containing the control electronics and mechanical interface components on a single structure mounted within a single recess.

SUMMARY OF THE INVENTION

An integrated protection unit which includes overcurrent protection along with auxiliary accessory function within a common enclosure contains an accessory cover for access to the selected accessory components to allow field installation of the accessory components. A combined actuator-accessory unit provides overcurrent, shunt trip or undervoltage release functions and is arranged within one part of the enclosure. The printed wire board containing the accessory control circuit is arranged within the same part of the enclosure.

DESCRIPTION OF THE PREFERRED EMBODIMENT

Figure 1:
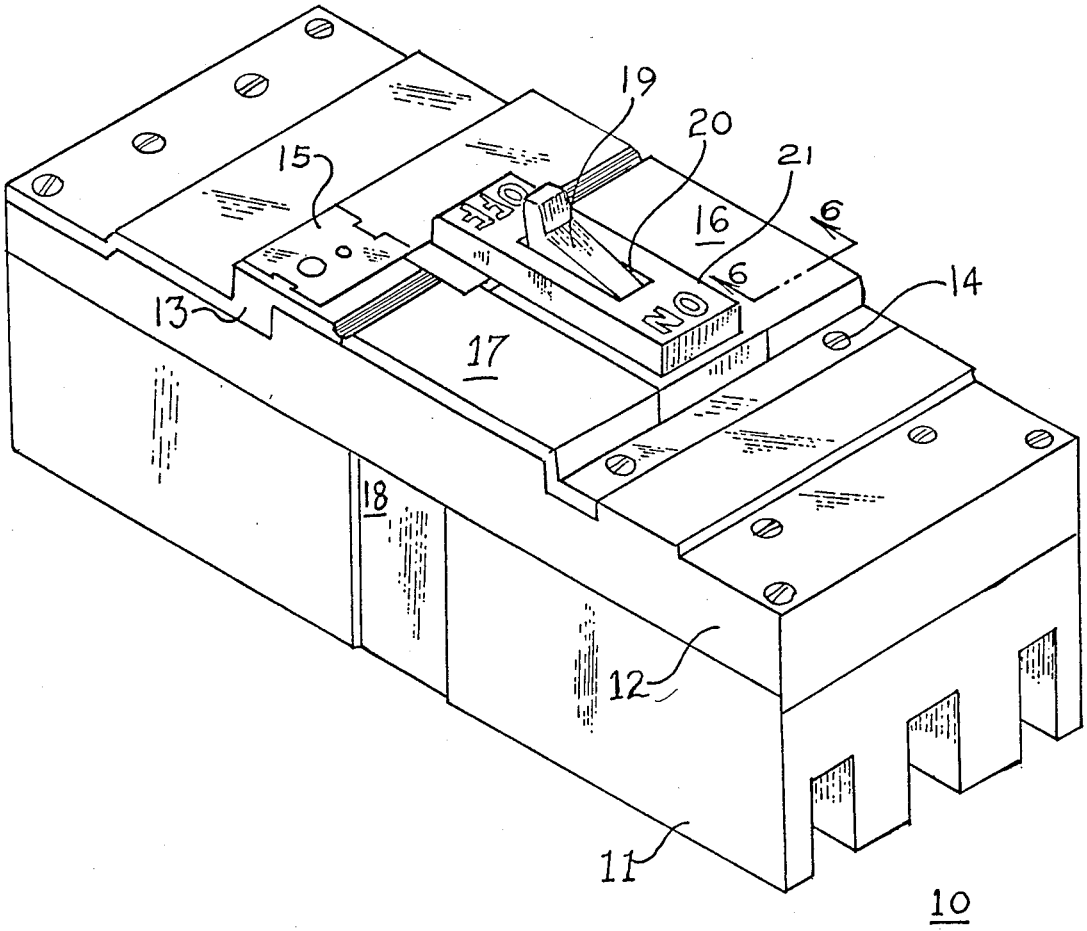
FIG. 1 is a top perspective view of an integrated molded case circuit breaker containing selected accessory functions.

An integrated circuit breaker 10 consisting of a molded plastic case 11 with a molded plastic cover 12 is shown in FIG. 1 with the accessory cover 13 attached to the circuit breaker cover by means of screws 14. The case includes a wiring slot 18 formed therein for allowing external connection with a remote switch or alarm. The circuit breaker operating handle 19 extends up from an access slot 20 formed in the cover escutcheon 21. A rating plug 15 such as described in U.S. patent application Ser. No. 045,645 filed May 4, 1987 entitled "Rating Plug Enclosure for Molded Case Circuit Breakers", which patent application is incorporated herein for reference purposes is shown assembled within the accessory cover. A pair of accessory doors 16, 17 are formed in the accessory cover for providing access to the combined electromagnetic actuator and multiple accessory unit 29, hereafter "actuator-accessory unit" contained within the recess 30, shown in FIG. 2. Still referring to FIG. 2, the rating plug 15 is fitted within a recess 26 formed in the accessory cover 13 and the accessory cover is fastened to the circuit breaker cover by means of screws 14, thru-holes 46 and threaded openings 47. Access to the rating plug interior for calibration purposes is made by means of the rating plug access hole 28.

The trip unit for the integrated circuit breaker 10 is contained within a printed wire board 23 which is positioned in the trip unit recess 25. The rating plug 15 when inserted within the rating plug recess 26 interconnects with the printed wire board by means of pins 24 upstanding from the printed wire board and sockets 27 formed on the bottom of the rating plug. An auxiliary switch 22 is positioned within the auxiliary switch recess 17A and is similar to that described in aforementioned U.S. patent application Ser. No. 133,868 filed Dec. 16, 1987 entitled "Molded Case Circuit Breaker Auxiliary Switch Unit". When the auxiliary switch and trip unit printed wire board have been assembled within their appropriate recesses, the actuator-accessory unit 29 is then installed within recess 30. The actuator-accessory unit includes a housing 31 within which the actuator-accessory coil 32 is enclosed and which further contains an armature 33 and armature spring 34 which projects the armature extension 35 and cap 41 in a forward trip position against the holding force provided by the energized actuator-accessory coil 32. The armature extension 35 projects through a slot 40 formed in one end of a trip actuator arm 39 at one end of the trip actuator latch 36. The trip actuator latch is pivotally attached to the housing 31 by means of a pivot pin 37 and by means of bracket 38. A hook 42 formed at one end of the trip actuator latch cooperates with the circuit breaker operating mechanism shown in aforementioned U.S. Pat. No. 4,700,161 in the manner to be described below in greater detail. The operation of the actuator-accessory unit 29 is similar to that described within U.S. Pat. Nos. 4,641,117 and 4,679,019 which patents are incorporated herein for purposes of reference. The actuator-accessory unit includes a printed wire board 66 which contains the components required for operating the actuator-accessory coil 32 and is connected with a pair of pins 44 upstanding from the trip unit printed wire board 23. A pair of wire conductors 45 connect the actuator-accessory unit with a remote switch or voltage source when undervoltage protection or shunt trip facility is desired.

Figure 2:
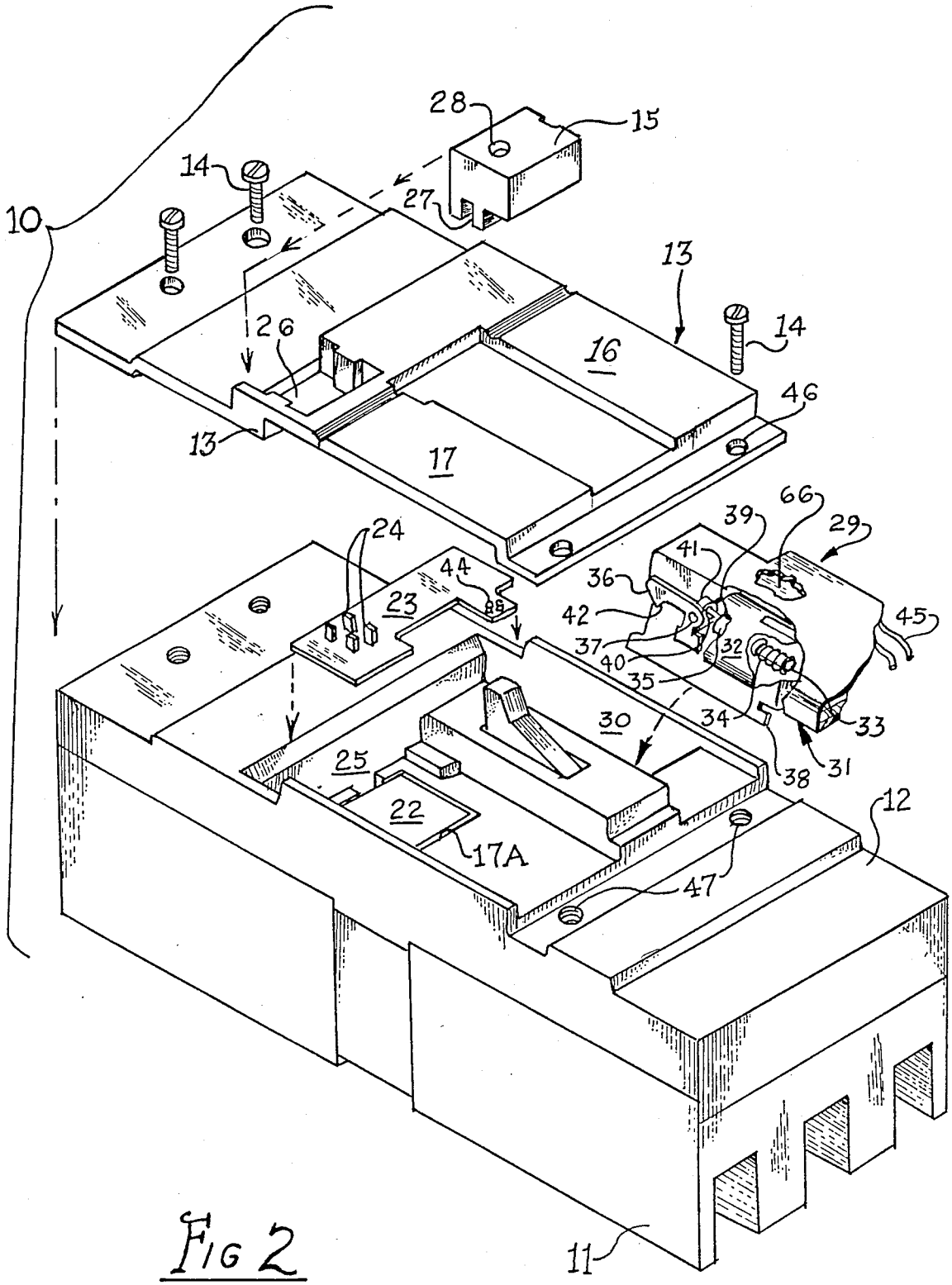
FIG. 2 is an exploded top perspective view of the integrated circuit breaker of FIG. 1 prior to assembly of the combined actuator-accessory unit according to the invention.
Figure 3:
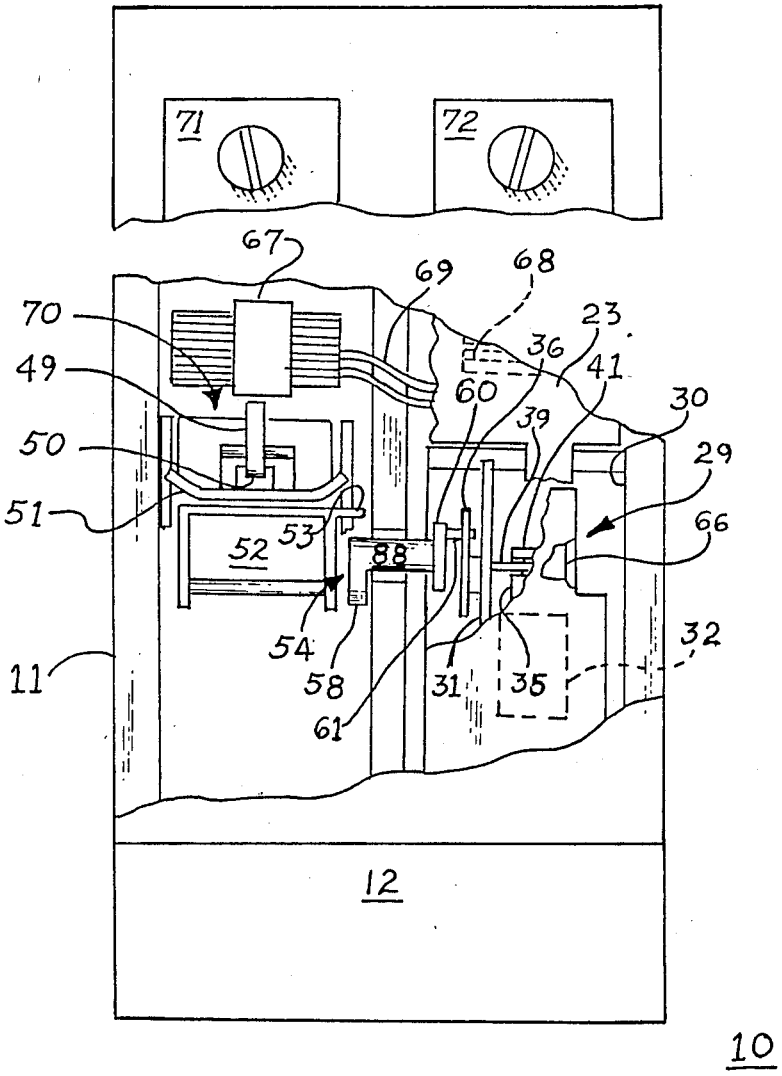
FIG. 3 is a plan view of the integrated molded case circuit breaker with part of the cover removed to show the circuit breaker operating mechanism and combined actuator-accessory unit.
Figure 4:
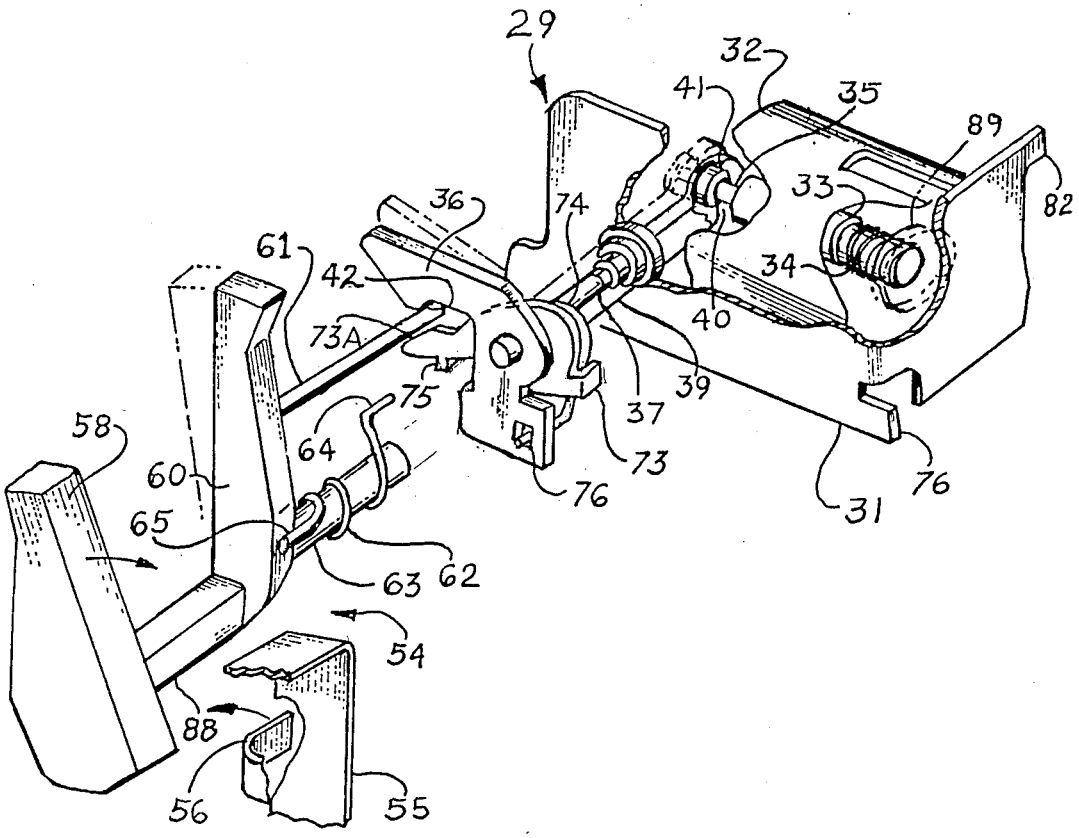
FIG. 4 is a side perspective view of one embodiment of the mechanical actuator and magnetic latch arrangement of the actuator-accessory of FIG. 3 in both latched and unlatched conditions.

The actuator-accessory unit 29 is depicted in FIG. 3 within the recess 30 in the integrated circuit breaker 10 with part of the trip unit printed wire board 23, actuator-accessory unit printed wire board 66 and cover 12 removed to show the interaction between the actuator-accessory unit and the mechanical actuator 54 which sits in the integrated circuit breaker case 11. The circuit breaker operating mechanism shown generally at 70 includes a cradle operator 49 having a hook 50 formed at one end thereof which is retained by means of a primary latch 51. The secondary latch assembly 52 prevents the primary latch 51 from releasing the operating cradle 49 until the secondary latch is displaced by contact with a tab 53 extending from the secondary latch. Electric current flow is sensed by a pair of current transformers 67, 68 which are located ahead of load lugs 71, 72. The current transformers connect with the trip unit printed wire board 23 by means of conductors 69. The operating lever 58 sits within the case 11 and connects with the latch support arm 60 in the recess 30 by means of connecting arm 88. The latch pin 61 is retained by the trip actuator latch 36 which is in turn controlled by the position of the trip actuator arm 39 which extends through the actuator-accessory housing 31. The trip actuator arm 39 interfaces with the cap 41 arranged at the end of the armature extension 35 in the following manner. When the circuit current exceeds a predetermined value, the holding current to the actuator-accessory coil 32 is interrupted thereby allowing the armature extension 35 to be propelled by the urgence of the armature spring and to thereby rotate the trip actuator latch 36 in the clockwise direction about pivot pin 37 and to release the hook 42 from the latch pin 61 as best seen by referring to the enlarged arrangement of the mechanical actuator 54 and actuator-accessory unit 29 shown external to the integrated circuit breaker as depicted in FIG. 4. The rotation of the trip actuator latch 36 to the "TRIPPED" position indicated in phantom allows the latch support arm 60 to rotate in the counterclockwise direction as indicated in phantom under the urgence of the powerful trip spring 62 arranged around the support rod 63 and retained within a recess formed in the integrated circuit breaker cover (not shown) at one end 64 and at the opposite end 65 by means of the latch support arm 60. The rotation of the latch support arm 60 in the counterclockwise direction drives the operating lever 58 (FIG. 3) into contact with tab 53 thereby articulating the circuit breaker operating mechanism 70, in the manner described earlier. The operating handle 19 shown in FIGS. 1 and 2 connect with a handle yoke 55 depicted in phantom in FIG. 4 to control the circuit breaker operating mechanism as described in detail within aforementioned U.S. Pat. No. 4,700,161. To reset the trip actuator latch 36, the operating handle and attached handle yoke 55 is first rotated in the counterclockwise direction as viewed in FIG. 4 which drives the reset tab 56, attached to the handle yoke, into contact with the operating lever 58. The counterclockwise motion of the handle yoke 55 rotates the operating lever 58 in the clockwise direction moving the latch support arm 60 which is attached thereto by means of connecting arm 88 in the clockwise direction and positions the latch pin 61 under the hook 42. Further rotation of the latch support arm 60 brings the latch pin 61 into contact with the surface 73A of the reset lever 73, rotating the reset lever counterclockwise about pivot 37. The rotation of the reset lever forces the tension spring 74 which is attached to the reset lever tab 75 at one end and to the trip actuator latch 36 by means of a slot 76 at an opposite end, to wind about pivot 37. This causes the trip actuator latch 36 to begin rotating in a counterclockwise direction. The counterclockwise rotation of the trip actuator latch 36 about pivot pin 37 in turn moves the trip actuator arm 39 and the armature cap 41 extending through slot 40 back from the "TRIPPED" position indicated in phantom to the "LATCHED" position indicated in solid lines provided that the actuator-accessory coil 32 is energized sufficient to hold the armature 33 against the forward bias of the armature spring 34. Should the actuator-accessory coil 32 remain de-energized, the armature spring 34 would prevent the armature 33 and armature extension 35 from allowing hook 42 to retain the latch pin 61. The role of the optional permanent magnet 89 depicted in phantom within the actuator-accessory housing 31 will be described below. The inability to reset the trip actuator latch 36 unless the actuator-accessory coil 32 is energized, is an important feature of this invention. This prevents the circuit breaker contacts (not shown) from closing in on a fault and causing damage to the contacts.

Figure 5:
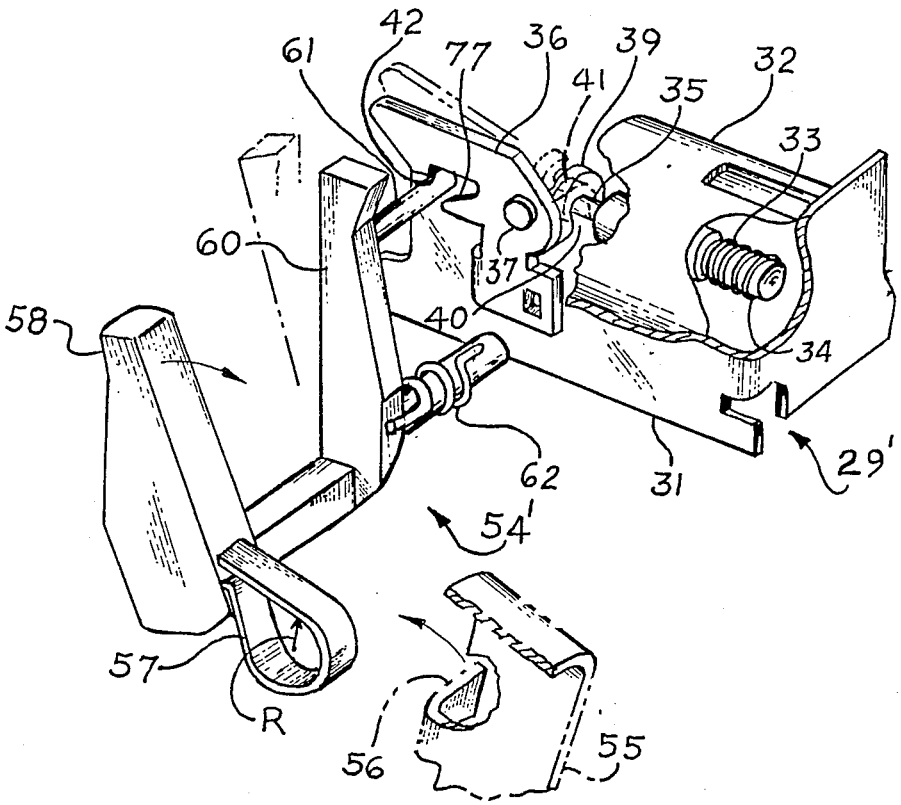
FIG. 5 is a side perspective view of an additional embodiment of the mechanical actuator and magnetic latch arrangement of the actuator-accessory of FIG. 3.

An alternate arrangement for resetting the trip actuator latch 36 is in the enlarged arrangement of the mechanical actuator 54' and actuator-accessory unit 29' shown external to the integrated circuit breaker as depicted in FIG. 5. Similar reference numerals will be employed to denote common operating components with the actuator-accessory unit 29 described earlier with reference to FIG. 4. To reset the trip actuator latch 36, the handle yoke 55 is rotated in the counterclockwise direction as viewed in FIG. 5 which drives the reset tab 56, attached to the handle yoke, into contact with the reset spring 57 which is attached to the operating lever 58. The reset spring 57 is a leaf spring which has a circular configuration of radius R such that when the reset tab 56 strikes the reset spring, the line of force acting on the reset spring during the reset operation is through the center of the spring radius and hence does not cause the spring to flex on contact. The counterclockwise motion of the handle yoke 55 rotates the operating lever 58 in the clockwise direction moving the latch support arm 60 in the clockwise direction and positions the latch pin 61 under the hook 42. Further rotation of the latch support arm 60 brings the latch pin 61 into contact with a projection 77 on the trip actuator latch 36 forcing the trip actuator latch to rotate in the counterclockwise direction. The counterclockwise rotation of the trip actuator latch 36 about pivot pin 37 in turn moves the trip actuator arm 39 back from the "TRIPPED" position indicated in phantom to the "LATCHED" position indicated in solid lines provided that the actuator-accessory coil 32 is energized sufficient to hold the armature 33 against the forward bias of the armature spring 34. Should the actuator-accessory coil 32 remain de-energized, the armature spring 34 would hold the armature 33 and armature extension 35 and armature cap 41 extended within slot 40 from allowing the hook 42 from retaining the latch pin 61 and hence cause the trip spring 62 to propel the latch support arm and operating lever to immediately articulate the integrated circuit breaker operating mechanism as described earlier. When the handle yoke 55 is moved further in the counterclockwise direction, and the trip actuator arm 39 forces the armature extension 35 and armature 33 against the forward bias of the armature spring 34, the force exerted by the reset tab 56 is directed away from the line of force of the reset spring causing the reset spring 57 to flex and allows for lost motion between the handle yoke 55 and the armature 33 once the armature has seated within the actuator-accessory coil 32 and actuator-accessory housing 31. When the circuit breaker handle yoke 55 is now rotated in the clockwise direction to close the circuit breaker contacts, tab 56 is brought out of contact with the operating lever 58 such that the actuator-accessory unit 29 is now capable of tripping the circuit breaker operating mechanism before the circuit breaker contacts can be closed, should the actuator-accessory coil 32 remain de-energized. The provision of the reset spring 57 and its location with respect to the reset tab 56 such that little or no flex is reflected by the reset spring upon initial contact when the handle operator is rotated in a counterclockwise direction and maximum flex is reflected against the reset tab when the armature is seated within the actuator-accessory coil 31 is also an important feature of this invention.

Figure 6:
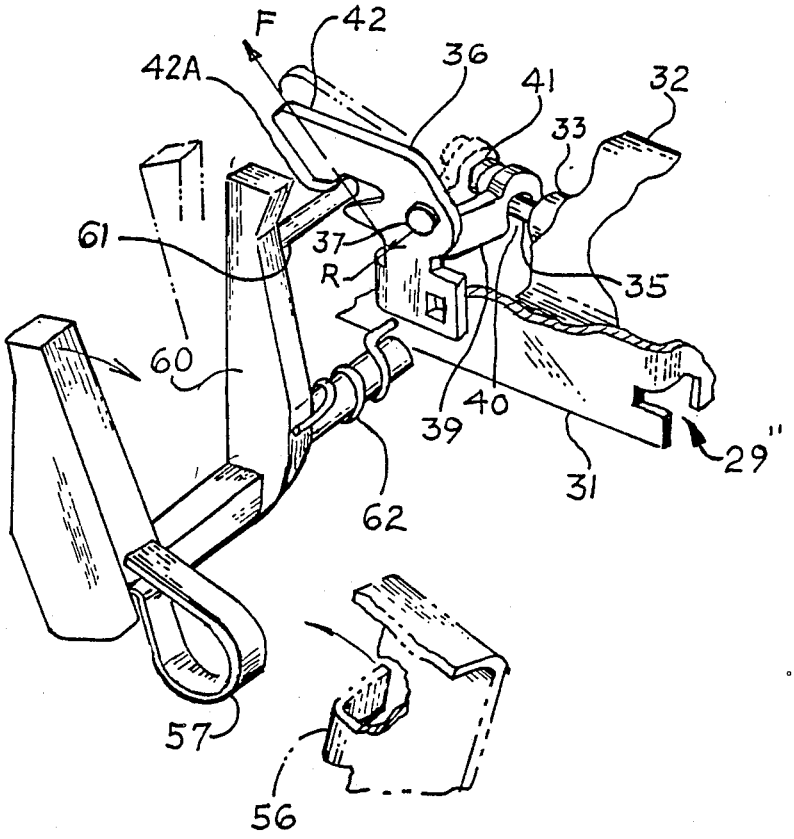
FIG. 6 is a side perspective view of a further embodiment of the mechanical actuator and magnetic latch arrangement of the actuator-accessory of FIG. 3.

A simplified actuator-accessory unit 29'' is depicted in FIG. 6 wherein the armature spring 34 of FIGS. 4 and 5 is eliminated and the trip spring 62 per se is used to propel the armature 33. This is accomplished by providing an inclined surface 42A on the hook 42 at the end of the trip actuator latch 36. The inclined surface is arranged perpendicular to a line of Force F generated by the trip spring a distance R from the pivot pin 37. This inclined surface receives the force through the latch pin 61 on latch support arm 60 and generates a torque on the trip actuator latch 36 which rapidly drives the trip actuator latch in the clockwise indicated direction as soon as the actuator-accessory coil 32 becomes de-energized. The force provided on the trip actuator latch is sufficient to pull the armature extension 35 and armature cap 41 within slot 40 in trip actuator arm 39 without the requirement of any additional spring within the actuator-accessory housing 31. The armature 33 is reset by interaction of the reset tab 56 and reset spring 57 in the same manner described earlier with reference to FIG. 5.

Figure 7:
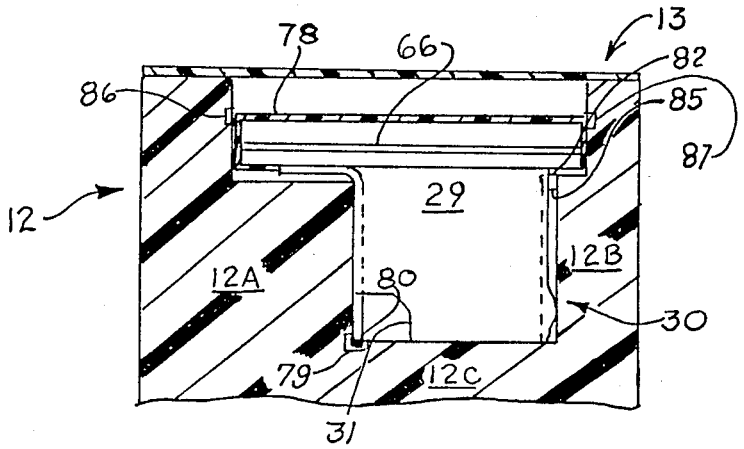
FIG. 7 is an enlarged end view in partial section the actuator-accessory unit within integrated molded case circuit breaker of FIG. 1.

The actuator-accessory units 29, 29', 29'' of FIGS. 4, 5 and 6 are arranged within the circuit breaker cover to depict an interlock feature inherent within the actuator-accessory unit according to the instant invention. Embodiments 29, 29', 29'' of the actuator-accessory each provide the interlock feature such that only actuator-accessory unit 29 is shown while describing the interlock feature best seen by now referring to FIG. 7. The actuator-accessory unit 29 fits within the actuator-accessory unit recess 30 between the side walls 12A, 12B and floor 12C of the integrated circuit breaker cover 12 such that the tab 80 on the actuator-accessory unit housing 31 (FIG. 5) is inserted within corresponding slot such as 79 formed within the bottom 12C of the actuator-accessory recess. A side projection 82 (FIG. 5) nests within a corresponding slot 85 formed within the circuit breaker cover side wall 12B for providing further stability to the actuator-accessory unit housing 31. The printed wire board 66 arranged on top of the actuator-accessory housing 31 sits beneath an additional cover 78 which in turn is supported on a pair of shelves 86, 87 that are formed within the cover side walls 12A, 12B. When the accessory cover 13 is removed from the integrated circuit breaker cover 12 and the actuator-accessory unit 29 is removed from the actuator-accessory recess 30, the trip actuator latch 36 which is pivotally attached to the actuator-accessory unit housing 31 by means of pivot pin 37 lifts away from latch support arm 60 which is retained within the recess 30 in the circuit breaker cover as best seen in FIGS. 3 and 4 such that the latch pin 61 is freed from the hook 42 and immediately moves to its "TRIPPED" position under the urgence of the trip spring 62, to articulate the integrated circuit breaker operating mechanism and separate the circuit breaker contacts.

When undervoltage release function is not required, a simple combined actuator-accessory unit is employed similar to that described within aformentioned U.S. Pat. No. 4,700,161 which includes a permanent magnet seated behind the actuator-accessory coil 32 as shown earlier in phantom at 89 in FIG. 4. This allows the combined trip actuator-accessory unit 29 to respond to overcurrent conditions and provide shunt trip facility without requiring the energizing of the actuator-accessory coil. The holding force for the armature 33 during the reset function then being supplied by the permanent magnet.

The circuits for providing undervoltage, shunt trip and overcurrent facility to a single actuator-accessory coil 32 are found within the aforementioned U.S. patent application Ser. No. 133,869. Once the trip unit printed wire board 23 (FIG. 3) senses an overcurrent condition above a predetermined quantity, the holding current to the actuator-accessory coil 32 is interrupted as decribed earlier. When a remote shunt trip function is to be initiated, the holding current to the actuator-accessory coil 32 is interrupted by means of the external switch connected to the wire conductors 45 (FIG. 2). When an undervoltage condition occurs such that the voltage applied to the wire conductors 45 from a remote source is less than a predetermined voltage, the holding flux developed by the accessory-actuator coil 32 is insufficient to hold the armature 33 against the bias provided by the armature spring 34 and hence the trip operation described earlier is achieved.

When the combined actuator-accessory unit containing the permanent magnet of FIG. 4 is used for overcurrent and shunt trip function, the actuator-accessory coil remains de-energized until such overcurrent or shunt trip function is desired. At which time a trip signal is applied to the overcurrent-accessory coil to produce an electromagnetic force in opposition to the holding force provided to the armature by the permanent magnets to thereby cause the armature to become propelled forward into contact with the circuit breaker trip bar as described in the aforementioned U.S. Pat. No. 4,700,161.

Having thus described my invention, what I claim as new and desire to secure by Letters Patent is:

1. A molded case circuit breaker having a combined trip actuator and accessory unit comprising:

a molded case circuit breaker case and cover;

a circuit breaker operating mechanism arranged for separating a pair of contacts to interrupt circuit current through said contacts;

a trip actuator-accessory unit within a recess in said circuit breaker cover proximate said operating mechanism for articulating said operating mechanism to separate said contacts automatically upon overcurrent conditions through said contacts and also to articulate said operating mechanism upon receipt of a remote trip signal;

an operating lever within said case proximate said operating mechanism and interfacing with said actuator-accessory unit through a latch support arm, said latch suport arm including means for retaining a trip actuator latch; and an electromagnetic coil and a spring-biased plunger within said actuator-accessory unit, said plunger being restrained from moving said trip actuator latch away from said latch support arm when said electromagnetic coil is energized.

2. The molded case circuit breaker of claim 1 including a trip spring biasing said latch support arm away from said trip actuator latch.

3. The molded case circuit breaker of claim 1 wherein said retaining means comprises a pin extending from a top part of said latch support arm.

4. The molded case circuit breaker of claim 2 wherein said trip actuator latch includes a hook-shaped end for retaining said pin.

5. The molded case circuit breaker of claim 4 including a reset lever interfacing with said trip actuator latch and said latch support arm whereby a projection on one end of said reset lever contacts said pin causing said hook-shaped end to engage said pin.

6. The molded case circuit breaker of claim 5 including a reset spring interfacing with said reset lever to bias said reset lever against said trip actuator latch.

7. The molded case circuit breaker of claim 2 including a rod extending from said latch support arm at a bottom end thereof, said trip spring being arranged on said rod.

8. The molded case circuit breaker of claim 1 including means on said trip actuator latch at an end opposite said hook-shaped end for engaging said plunger to cause said trip actuator latch to rotate in response to lateral movement of said plunger.

9. The molded case circuit breaker of claim 1 including a housing comprising a side wall, said electromagnetic coil and said plunger being mounted on one side of said side wall, said trip actuator latch and said reset lever being pivotally arranged on an opposite side of said side wall.

10. The molded case circuit breaker of claim 1 including a circuit breaker operating handle connected with said operating mechanism by means of a handle yoke, said handle yoke being arranged proximate said operating lever within said case whereby movement of said operating handle drives said handle yoke into contact with said operating lever to thereby rotate said latch support arm and said pin into a latched relation with said trip actuator latch.

11. A molded case circuit breaker having a combined trip actuator and accessory unit comprising:

a molded plastic circuit breaker case and cover;

an operating mechanism arranged for separating a pair of contacts to interrupt circuit current through said contacts;

a trip actuator accessory unit within a recess in said circuit breaker cover proximate said operating mechanism for articulating said operating mechanism to separate said contacts automatically upon overcurrent conditions through said contacts and to articulate said operating mechanism upon receipt or of a remote trip signal;

an operating lever within said case proximate said operating mechanism and interfacing with said actuator-accessory unit through a latch support arm, said latch support arm including means for retaining a trip actuator latch;

an electromagnetic coil and a spring-biased plunger within said actuator-accessory unit, said plunger being restrained from moving said trip actuator latch away from said latch support arm when said electromagnetic coil is energized; and a trip spring associated with said latch support arm for biasing said latch support arm and said operating lever in a predetermined direction.

12. The molded case circuit breaker of claim 11 including a hook-shaped end on said trip actuator latch.

13. The molded case circuit breaker of claim 12 wherein said retaining means comprises a pin extending from said latch support arm.

14. The molded case circuit breaker of claim 12 including means on an end of said trip actuator latch opposite said hook-shaped end said means being associated with said plunger to cause said trip actuator latch to rotate in response to lateral movement of said plunger.

15. The molded case circuit breaker of claim 11 including a rod extending from a bottom of said latch support arm, said trip spring being arranged on said rod.

16. The molded case circuit breaker of claim 11 including a reset spring arranged at one end of said operating lever.

17. The molded case circuit breaker of claim 16 including an operating handle associated with said operating mechanism and including a handle yoke, whereby rotation of said operating handle drives said handle yoke into contact with said reset spring thereby rotating said operating lever in a predetermined direction.

18. The molded case circuit breaker of claim 17 wherein said reset spring comprises a leaf spring defining a center of action, whereby initial contact with said handle yoke is through said center of action.

19. The molded case circuit breaker of claim 18 whereby further contact with said leaf spring is outside said center of action thereby causing said leaf spring to flex.

20. A molded case circuit breaker having a combined trip actuator and accessory unit comprising:

a molded plastic circuit breaker case and cover;

an operating mechanism arranged for separating a pair of contacts to interrupt circuit current through said contacts;

a trip actuator accessory unit within a recess in said circuit breaker cover proximate said operating mechanism for articulating said operating mechanism to separate said contacts automatically upon overcurrent conditions through said contacts and to articulate said operating mechanism upon receipt or of a remote trip signal;

an operating lever within said case proximate said operating mechanism and interfacing with said actuator-accessory unit through a latch support arm, said latch support arm including means for retaining a trip actuator latch;

an electromagnetic coil and a plunger within said actuator-accessory unit, said plunger being held in a first position when said electromagnetic coil is energized; and a trip spring associated with said latch support arm biasing said latch support arm and said operating lever for rotation in a predetermined direction;

said trip actuator means comprising a pin extending from a top part of said latch support arm, said retaining means comprising an inclined surface formed on one end of said trip actuator latch;

said trip actuator latch being pivotally attached to said trip actuator-accessory unit at a predetermined pivot point, said pivot point being arranged a predetermined distance from said inclined surface whereby said trip spring provides sufficient torque on said trip actuator latch and said plunger to thereby cause said plunger to extend to a second position when said electromagnetic coil is de-energized.

21. The molded case circuit breaker of claim 20 wherein said plunger includes means capturing an end of said trip actuator latch opposite said inclined surface.

22. The molded case circuit breaker of claim 21 including a rod extending from said latch support arm at a bottom thereof, said trip spring being supported on said rod and associated with said plunger to cause said trip actuator latch to rotate in response to lateral movement of said plunger.

23. The molded case circuit breaker of claim 22 including a reset spring on one end of said operating lever.

24. The molded case circuit breaker of claim 23 including an operating handle extending within said case and interfacing with said operating mechanism through a handle yoke, whereby movement of said operating handle carries said handle yoke into contact with said reset spring thereby rotating said operating lever in a predetermined direction.

25. The molded case circuit breaker of claim 24 wherein said reset spring comprises a leaf spring defining a fixed center of action, said handle yoke initially striking said reset spring in a first direction through said center of action.

26. The molded case circuit breaker of claim 25 wherein continued movement of said operating handle directs said handle yoke in a second direction away from said fixed center of action thereby causing said reset spring to become flexed.

27. A molded case circuit breaker having a combined trip actuator and accessory unit comprising:

a molded case circuit breaker case and cover;

a circuit breaker operating mechanism arranged for separating a pair of contacts to interrupt circuit current through said contacts;

a trip actuator-accessory unit within a recess in said circuit breaker cover proximate said operating mechanism for articulating said operating mechanism to separate said contacts automatically upon overcurrent conditions through said contacts and also to articulate said operating mechanism upon receipt of a remote trip signal;

an operating lever within said case proximate said operating mechanism and interfacing with said actuator-accessory unit through a latch support arm, said latch suport arm including means for retaining a trip actuator latch, and bias means arranged to rotate said operating lever to articulate said operating mechanism; and an electromagnetic coil and a spring-biased plunger within said actuator-accessory unit, said plunger being restrained from moving said trip actuator latch away from said latch support arm when said electromagnetic coil is energized, whereby removing said trip actuator-accessory unit from said recess disengages said retaining means from said trip actuator latch thereby causing said operating lever to automatically articulate said operating mechanism.

28. The molded case circuit breaker of claim 27 including means for accessing said trip actuator-accessory unit recess without removing said molded case circuit breaker cover.

29. The molded case circuit breaker of claim 28 further including means intermediate said accessing means and said trip actuator-accessory unit to prevent unauthorized removal of said trip actuator-accessory unit.

* * * * *